US008158204B1

(12) United States Patent
Fischer et al.

(10) Patent No.: US 8,158,204 B1
(45) Date of Patent: Apr. 17, 2012

(54) METHOD OF PRODUCING THIN, POORLY SOLUBLE COATINGS

(75) Inventors: Christian-Herbert Fischer, Berlin (DE); Martha Christina Lux-Steiner, Berlin (DE); Hans-Juergen Baecker, Hamburg (DE)

(73) Assignee: Helmholtz-Zentrum Berlin Fuer Materialien und Energie GmbH, Berlin (DE)

( * ) Notice: Subject to any disclaimer, the term of this patent is extended or adjusted under 35 U.S.C. 154(b) by 0 days.

(21) Appl. No.: 09/958,443

(22) PCT Filed: Apr. 6, 2000

(86) PCT No.: PCT/DE00/01173

§ 371 (c)(1),
(2), (4) Date: Oct. 8, 2001

(87) PCT Pub. No.: WO00/60135

PCT Pub. Date: Oct. 12, 2000

(30) Foreign Application Priority Data

Apr. 6, 1999 (DE) ..... 199 16 403

(51) Int. Cl.
*B05D 3/02* (2006.01)
*B05D 3/04* (2006.01)
*C23C 16/00* (2006.01)

(52) U.S. Cl. .... 427/343; 427/76; 427/126.1; 427/126.2; 427/226; 252/492; 501/152; 501/906

(58) Field of Classification Search ..... 427/331, 427/226, 343, 348, 349, 377, 379, 380, 383.1, 427/398.5, 255.395, 255, 248.1, 421, 427, 427/430.1

See application file for complete search history.

(56) References Cited

U.S. PATENT DOCUMENTS

| | | | | |
|---|---|---|---|---|
| 4,242,374 A | | 12/1980 | Sansregret | |
| 5,106,828 A | * | 4/1992 | Bhargava et al. | 505/440 |
| 5,837,011 A | * | 11/1998 | Wong | 501/152 |

FOREIGN PATENT DOCUMENTS

| | | |
|---|---|---|
| DE | 198 31 214 | 9/1999 |
| EP | 0580019 | 1/1994 |
| WO | WO-9948158 | 9/1999 |

OTHER PUBLICATIONS

Technische Keramik; Vulakn Verlag, Essen, Germany, 1988.

(Continued)

*Primary Examiner* — Michael Cleveland
*Assistant Examiner* — Alexander Weddle
(74) *Attorney, Agent, or Firm* — Leydig, Voit & Mayer, Ltd.

(57) ABSTRACT

For making ceramic or oxidic layers (CL/OL) on substrates (S), the method according to the invention therefore provides that following application (I) and drying (II) of a suitable precursor (P) the formed precursor layer (PLD) is gassed (III) with a moist reactant gas (RG) for conversion into a corresponding hydroxide or complex layer (HL) and then thermally treated (IV) for forming a ceramic or oxidic layer (CL/OL). For the alternative production of other chalcogenidic layers of increased material conversion additional gassing is carried out with a reactant gas containing chalcogen hydrogen. Metallic layers may alternatively be made by use of a reducing reactant gas. The methods in accordance with the invention may be used wherever surfaces, even those of shaded structures, must be protected or modified or provided with functional layers, particularly in solar and materials technology.

16 Claims, 2 Drawing Sheets

OTHER PUBLICATIONS

Bhaumik et al.: Laser annealing of zinc oxide thin film deposited by spray-CVD; Materials Science and Engineering B52 (1998); p. 25-31.

Studenikin et al.: Optical and electrical properties of undoped ZnO films grown by spray pyrolysis of zinc nitrate solution; Journal of Applied Physics, vol. 83, No. 4, Feb. 15, 1998, pp. 2104-2111.

Yamaya et al.: Use of helicon-wave excited plasma for aluminum-doped ZnO thin-film sputtering; Appl Phys. Lett. 72 (2), Jan. 12, 1998; pp. 235-237.

Chen et al.: Plasma assisted molecular beam epitaxy of ZnO on c-plane sapphire: Growth and characterization; Journal of Applied Physics, vol. 84, No. 7; Oct. 1, 1998; pp. 3912-3918.

Peulon et al.: Preparation of ZnO films by electrodeposition from aqueous solutions; 13th European Photovoltaic Solar Energy Conference, Nice, France, Oct. 23-27, 1995; pp. 1750-1752.

Ohya et al.: Microstructure of TiO2 and ZnO films fabricated by the Sol-Gel method; J.Am.Ceram. Soc.; 79(4)pp. 825-830; (1996).

Nii et al.: Effects of Cd-free buffer layer for CuInSe2 thin-film solar cells; CH3365-4/94/0000-0254 IEEE; 1994.

J. Moeller et al. "$CuInS_2$ as an Extremely Thin Absorber in an Eta Solar Cell", 2nd World Conference and Exhibition on Photovoltaic Solar Energy Conversion, Jul. 6-10, 1998, Vienna, pp. 209-211, XP002110735.

"Technische Keramik" Publisher B. Thier, Vulcan Verlag, Essen 1988, by the Deutsche Keramische Gesellschaft (German Ceramic Society), pp. 2 to 25.

G. K. Bhaumik et al. "Laser Annealing of Zinc Oxide Thin Film Deposited by Spray-CYD", Elsevier Materials Science and Engineering B52 (1998), pp. 25-31.

S. A. Studenikin et al. "Optical and Electrical Properties of Undoped zno Films Grown by Spray Pyrolysis of Zinc Nitrate Solution", J. of Appl. Phys. Yol. 83, No. 4, Feb. 15, 1998, pp. 2104-2111.

K. Yamaya et al. "Use of a Helicon Wave Excited 30 Plasma of Aluminium-Doped ZnO Thin-Film Sputterin", Appl. Phys. Lett. 72(2), Jan. 12, 1998, pp. 235-237.

Y. Chen et al. "Plasma Assisted Molecular Beam Epitaxy of ZnO on c-Plane Sapphire: Growth and Characterization" , J. of Appi. Phys., 5 vol. 84, No. 7, Oct. 1, 1998, pp. 3912-3918.

S. Peulon et al. "Preparation of ZnO Films by Electrodepasition from Aqueous Solution", 13th Europ. 10 Photovaltaic Solar Energy Conference, Oct. 23-27, 1995. Nice, France, pp. 1750-1752.

Y. Ohya et al. "Microstructure of Ti02 and ZnO Films Fabricated by the Sal-Gel-Method", J. Am. Ceram. Q., Soc. 79[4], (1996), pp. 825-830.

T. Nii et al. "Effects of Cd-Free Buffer Layer for CuInSe2 Thin Solar Cells", First WCPEC; Dec. 5-9, 1994; Hawaii, pp. 254-257.

* cited by examiner

METHOD OF PRODUCING THIN, POORLY SOLUBLE COATINGS

CROSS-REFERENCE TO PRIOR APPLICATIONS

This application is a U.S. National Phase application under 35 U.S.C. §371 of International Application No. PCT/DE00/01173, filed on Apr. 6, 2000, and claims benefit to German Patent Application No. DE 199 16 403.7, filed on Apr. 6, 1999. The International Application was published in German on Oct. 12, 2000 as WO 00/60135 under PCT Article 21(2).

BACKGROUND OF THE INVENTION

1. Field of the Invention

The invention relates to a method of making thin poorly soluble coatings on substrates of any desired morphology. In this context, preferably ceramic and oxidic layers, and also metallic as well as further chalcogenidic layers are to be producible as well.

2. The Prior Art.

As defined (see "Technische Keramik" Publisher B. Thier, Vulcan Verlag, Essen 1988, pages 2 to 25) by the Deutsche Keramische Gesellschaft (German Ceramic Society), ceramic materials are inorganic, non-metallic, poorly soluble in water and at least 30% crystalline. They may, however, be extended to the group of glasses, glass ceramics and inorganic binding agents. The ceramic materials are subdivided into the two main groups of "functional ceramics" and "structural ceramics". Structural ceramics are materials based on oxides and silicates as well as on carbides, nitrides, borides and silicides ($MoSi_2$) of major group elements.

When viewed systematically, "oxide ceramics" would be understood to be all those ceramic materials consisting essentially (>90%) of single-phase and single-component metal oxides. By contrast, all materials based upon ceramically produced materials from the system of boron, carbon, nitrogen, silicon and, in certain circumstances, oxygen are called non-oxide-ceramics. Oxide ceramic materials are polycrystalline materials made from pure oxides or oxide compounds; they are of high purity and are usually free of a vitreous phase. In addition to the high-melting metal oxides, such as, for instance, aluminum-, zirconium-, magnesium-, titanium- and berryllium oxide, and calcium oxide, magneto-ceramic materials and materials of high dielectric constant, piezo-ceramic, may also be included. However, limitation to high-melting oxides is customary. However, silicon dioxide ($SiO_2$) is not classified as oxide ceramic. For this reason and in recognition of further oxides which, while suitable, do not belong to ceramic materials, the invention relates also to the making of ceramic as well as oxidic layers. Furthermore, oxide ceramic materials are distinguished between simple oxides and complex oxides. Among these are, for instance, chromite of coarse structure and perovskites, ferrites and garnets of fine structure.

Hitherto poorly soluble coatings have, for instance, been applied to surfaces by sputtering or vapor deposition, by sol-gel techniques, chemical bath deposition or by metal organic chemical vapor deposition (MOCVD). From the essay "Laser Annealing of Zinc Oxide Thin Film Deposited by Spray-CVD" by G. K. Bhaumik et al., Elsevier Materials Science and Engineering B52 (1998) 25-31, it is known to apply a polycrystalline ZnO film to quartz and silicon substrates by the spray-CVD method. To improve its crystal structure, the applied film may then be heated by laser irradiation. The accumulation of undoped ZnO films by spray pyrolysis with an aqueous solution of zinc nitrate is known from the essay "Optical and Electrical Properties of Undoped ZnO Films Grown by Spray Pyrolysis of Zinc Nitrate Solution" by S. A. Studenikin et al., J. Of Appl. Phys. Vol. 83, No. 4, 15 Feb. 1998, 2104-11). The essence of this essay resides in detecting the relationship between the temperature of the pyrolysis and the structural, electrical and optical properties of the ZnO film. Different temperatures were attained by heating the sample substrate, for instance in nitrogen at 400° C.

During sputtering (for ZnO, see: "Use of a Helicon Wave Excited Plasma of Aluminium-Doped ZnO Thin-Film Sputtering" by K. Yamaya et al., Appl. Phys. Lett. 72(2), 12. January 1998, 235-37) atoms are severed from a metal cathode by impinging ions of a gaseous discharge ("cathode sputtering"). The sputtered metal then precipitates as a uniform layer on a surface. Mono-crystalline ZnO thin-layers may be deposited on c-planar sapphire (see "Plasma Assisted Molecular Beam Epitaxy of ZnO on c-Plane Sapphire: Growth and Characterization" by Y. Chen et al., J. Of Appl. Phys., Vol. 84, No. 7, 1 Oct. 1998, 3912-18) by molecular beam epitaxy using oxygen-containing plasma in the presence of a microwave field. Good quality ZnO films may also be made by direct electro-deposition at a low process temperature from aqueous solutions (see: "Preparation of ZnO Films by Electrodeposition from Aqueous Solution" by S. Poulon et al., 13th Europ. Photovoltaic Solar Energy Conference, 23-27, October 1995. Nice, France, 1750-52). In the sol-gel technique (see: "Microstructure of $TiO_2$ and ZnO Films Fabricated by the Sol-Gel-Method" by Y. Ohya et al., J. Am. Ceram. Soc. 79[4] 825-30 (1996), colloidal solutions present as the sol solidify to a gel by reaction with water and removal of solvents with rigidly adsorbed solvent residue. The gel accumulates on surfaces and may be dried.

In the chemical bath deposition (CBD) (for ZnO/CDs/CIS/Mo structures see: "Effects of Cd-Free Buffer Layer for $CuInSe_2$ Thin Solar Cells" by T. Nii et al., First WCPEC; Dec. 5-9, 1994; Hawaii, 254-57), the two different variants "SILAR method" (Successive Ionic Layer Adsorption and Reaction) and "Chalcogeno-Urea Method" are used in the production of poorly soluble metal chalcogenide layers.

The subject matter of the publication "$CuInS_2$ as an Extremely Thin Absorber in an Eta Solar Cell" by J. Möller et al. (Conference Proceedings of the 2nd World Conference and Exhibition on Photovoltaic Solar Energy Conversion, 6-10 Jul. 1998, pages 209-211, XP 002110735 Vienna) is a method, based upon the above-captioned methods, for the improved manufacture of thin metal chalcogenide layers naming different material compositions. In this method, a solution of a metal compound is initially applied to a substrate so that ions are deposited thereon. The solvent is then removed from the substrate by a drying process. Thereafter, the deposited ion layer is contacted by a chalcogen hydrogen containing gas to bring about a reaction with the metal ions. Homogenous metal chacoginide layers of constant quality may be produced in a simple manner by this method. Such layers can be applied, for instance, as absorber or buffer layers in solar cells. The closest prior art upon which the present invention is based is this essay.

The prior art method may be called ILGAR (Ionic Layer Gas Reaction) process.

OBJECTS OF THE INVENTION

Relative to the known method, it is to be the task of the present invention to make possible the production of further surface layers in other material compositions. Yet the method is to be simple in its sequence as well as in ecological and economic respects. Furthermore, the usable materials are to yield an extended range of applications. A subordinate object of the invention is to provide a qualitatively improved coating while improving the utilization of the materials used, relative to known coatings of a chalcogenide structure.

BRIEF SUMMARY OF THE INVENTION

For that reason, the solution to the mentioned main problem is a method of making thin poorly soluble coatings on substrates of any desired morphology, including the following method steps of making ceramic or oxidic layers to be cyclically carried out depending upon the desired thickness of the layer:

I. Applying at least one starter substance or precursor suitable for the layer structure on the surface of the substrate;
II. Drying the formed precursor layer in an inert gas stream or by evaporation;
III. Gassing the dried precursor layer with a moist reactant gas for conversion into a corresponding hydroxide or complex layer;
IV. Thermally treating the formed hydroxide or complex layer for forming the respective final layer and, thereafter, depending upon the occurrence of non-converted precursors or undesired byproducts:
V. Removal of such non-converted precursors or byproducts by rinsing followed by drying.

Another solution of the posed problem for an alternative production of metallic layers is provided by an analog method including the following method steps:

I. Applying at least one precursor suitable for forming a layer on the surface of the substrate;
II. Drying the formed layer of precursor substance in an inert gas stream or by evaporation;
III. Gassing the layer of precursor substance in a moist reducing reactant gas for forming a metallic layer; and
IV. Thermally treating the formed metal layer to remove non-converted precursors or undesired byproducts.

A further solution of the posed problem for an alternative production of other chalcogenidic coatings is additionally provided by an analog method including the following method steps:

I. Applying at least one precursor suitable for forming a layer on the surface of the substrate;
II. Drying the formed layer of precursor in an inert gas stream or by evaporation;
III. Gassing the dried layer of precursor with a moist reactant gas for conversion into a corresponding hydroxide or complex layer;
IIIa. Gassing of the hydroxide or complex layer with an additional reactant gas containing chalcogen hydrogen compounds for forming the chalcogenidic final layer, and
IV. Thermally treating the formed hydroxide or complex layer and/or of the chalcogenidic final layer.

Advantageous further developments of the method in accordance with the invention for the alternative production of ceramic and oxidic, metallic or other chalcogenidic layers may be gathered from the following description. Their content is hereinafter implicitly explained in connection with the general explanations of the invention.

Films of poorly soluble oxides and of such compounds in general which are formed by conversion of a dry rigid precursor with a gaseous reaction component, may be made in a simple fashion by the method in accordance with the invention. To this end, the hydrolysis initially performed for forming hydroxides or complexes by subjecting a precursor dried to a homogenous surface is decisive. Using moist anhydrous ammonia as the reactant gas, these complexes may, for instance, be ammine complexes. However, the reactant gas may also be a vapor, preferably an alkaline reaction one, or, in certain circumstance, water vapor by itself. The term "vapor" always connotes moist gasses, i.e., a mixture of gaseous water, alkaline gas and, in most cases, an inert carrier gas. Moist anhydrous ammonia is obtained simply by bubbling nitrogen through a bubbler containing a solution of aqueous ammonia. Thus, the making of metallic layers by gassing requires treatment with a reducing gas.

The desired ceramic or oxidic surface layers or other final layers are then made, following gassing, by the thermal dehydration treatment and, in the case of complexes, also by removing ligands. The thermal treatment of the hydroxide or complex layers may be carried out in a separate method step, for instance by heating of the layers in a furnace, following gassing with the reactant gas. It may also be integral with the process by raising the process temperature during gassing. The application of a higher temperature may in certain circumstances eliminate the optional purifying step, since it allows removal of undesired substances from the film. In certain cases an oxide may be directly formed without selectively applying an increased temperature. In the production of chalcogenidic layers the thermal treatment may be applied to both of the required gassings. In individual instances, the thermal treatment for forming the respective final layer may be understood as constituting the removal of interfering components. In the production of metallic layers the increased temperature is employed to remove undesired byproducts.

As a rule, the precursor is of a metal compound, for instance of such metal halogens as $ZnCl_2$ or $AlCl_3$, of the metal the oxide, ceramic (e.g. ZnO, $Al_2O_3$) or metal of which is desired as the final coating product. The corresponding dissolved metal salt is then applied to the substrate, dried (optionally up to a defined residual moisture content) and converted with gaseous reaction partners.

Layers made by the method in accordance with the invention may be used in solar technology for the fabrication of many components of solar cells. In the materials technology, the method will permit to coat any number of smooth, rough and porous substrates. Furthermore, by using mixtures of precursors, or different substances, and by using them alternatingly, the method also makes it possible to make homogenous doped layers and mixed layers as well as multiple layers. The thin poorly soluble layers may be particularly used wherever extended surface protection must be provided. This may simply be mechanical or chemical protection of a surface; but it may also relate to affecting the physical and chemical properties of their surfaces such as, e.g., conductivity, reflection and absorption characteristics or catalysis or chemical absorption.

Compared to prior art methods, mention should be made of the following further advantages:

- low costs, in view of moderate uncritical process parameters, no vacuum;
- insensibility against variations in the process temperature;
- simple setting of the layer thickness by the number of performed cycles;
- high reproducibility of the fabricated layers;
- homogenous coating of substrates of any desired surface;
- coating also of shielded internal surfaces;
- total use of the precursors; and
- simple to automate.

Based upon the crystal structure of the precursor, the ILGAR method described in prior German patent specification 198 31 14.8 in certain cases leads to a change in the crystal structure during the chalcogenizing step for the formation of sulfides, selenides or tellurides. This requires an energy of phase transition, however, which is available to a limited extent only when the ILGAR method is practiced at room temperature. It thus leads to a reduced conversion of the precursor into the endproduct or to a slower reaction rate, so that residue of the precursor remains embedded in the thin metal chalcogenide film which can only be removed by additional rinsing steps. Hence, film of reduced quality and an increased precipitation period may be expected in the ILGAR method.

By comparison, the method in accordance with the invention offers an improvement. To this end, for the alternative production of other chalcogenidic coatings, they are gassed, following the conversion of the dried layer of precursor into a corresponding hydroxide or complex layer, with an additional reactant gas containing chalcogen hydrogen compounds. By forming a metal hydroxide and integrating the heating process, this reaction method leads to markedly higher yields which results in less residual precursor in the final product. With chalcogenides based upon sulfur, selenium and tellurium, moist anhydrous ammonia ($NH_3$) may also be used as the additional reactant gas. The activation energy resulting from this intermediate step may be considered as a possible explanation of this effect. Moreover, many metal hydroxides have no crystal structure; rather, they are amorphous. This makes them less compact and permit improved penetration of the reactant gas into the layer to be chalcogenized.

As regards the generally known annealing, the increased energy requirement during the crystal conversion may also be made available directly by an increased process temperature during the chalcogenizing step. In this connection, irradiation of the substrate with a halogen lamp may already be sufficient. It is also possible to carry out the chalcogenizing step in a furnace. These described measures lead to purer thin films of higher value while at the same time reducing the quantity of the required chalcogen hydrogen containing reactant gas, and they reduce the deposition time since time-consuming rinsing steps which may also reduce the quality of the endproduct may be dispensed with. In case of a hydroxide reaction, no precursor residue is to be expected; the byproducts which may occur in this connection are highly volatile and may be removed during the final method step. If, however, the crystal size of the endproduct is to be maintained small while maintaining a large turn-over, the temperature should be increased as little as possible only so that in such a case the combination of the hydroxide step and insignificantly increased process temperature is reasonable. Nano-crystallites are acquiring more and more significance in research and technology because in thin films they lead to quantum size effects which affect the optical and electrical properties of the material.

DESCRIPTION OF THE DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DESCRIPTION OF THE PREFERRED EMBODIMENTS

Figure 1:
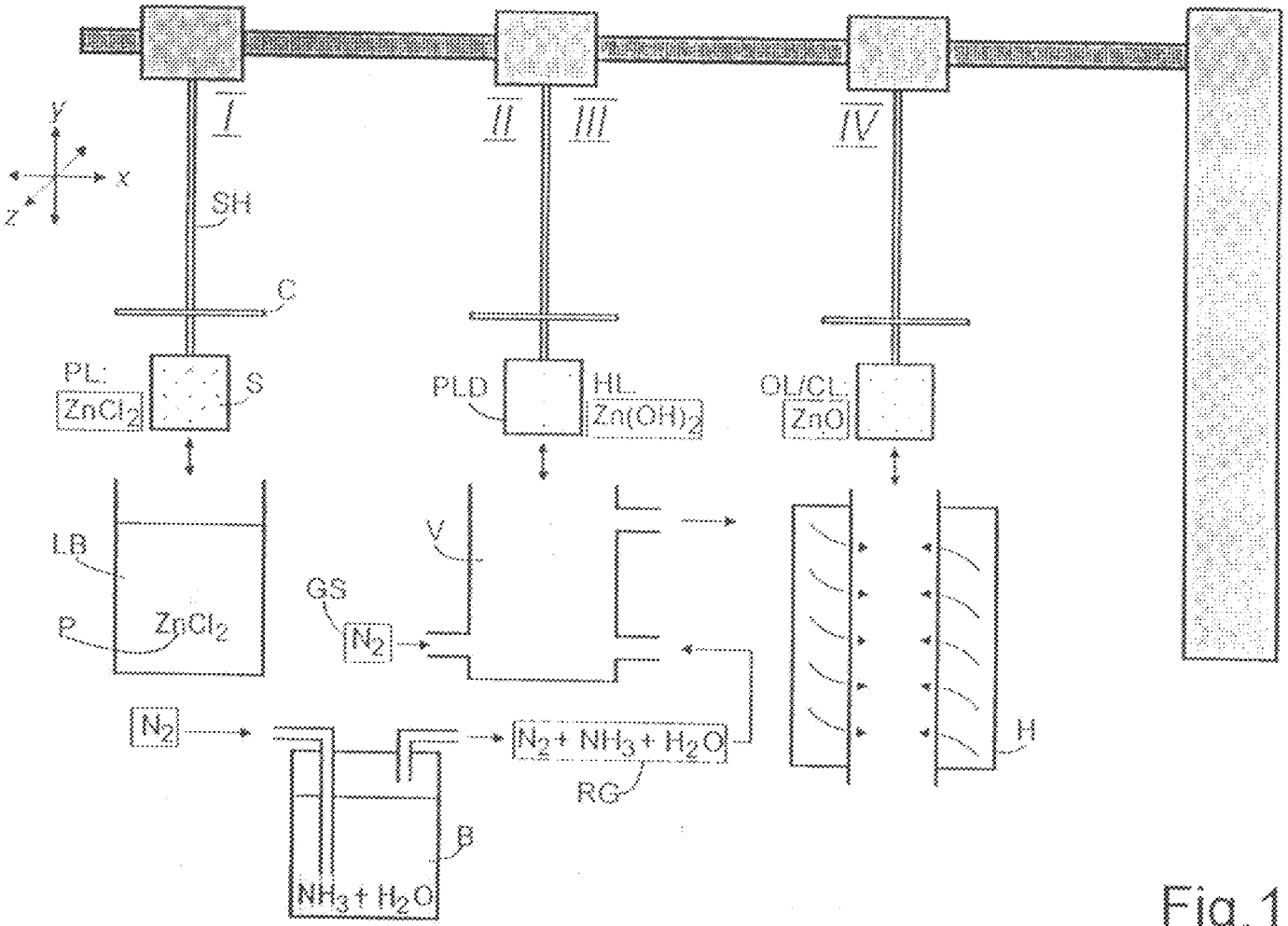
FIG. 1 depicts the process sequence in accordance with the invention during production of a ceramic coating in a suitable arrangement and FIG. 2 depicts the process sequence in accordance with the invention during production of a chalcogenidic coating.

FIG. 1 depicts the production of a zinc oxide layer on an amorphous substrate S mounted in a substrate holder SH which is movable in three-dimensional space. For covering the individual baths, the substrate holder SH is provided with a lid C. In a first method step I, the substrate S is immersed in a suitable starter substance P (precursor). In the chosen embodiment this is a solvent bath LB containing the dissolved metal compound zinc chloride ($ZNCl_2$). After withdrawal, a precurcor layer, in this case $ZnCl_2$, is present on the surface of the substrate.

In a second method step II, the $ZnCl_2$ layer is first dried in a vessel V, for instance, by introducing a gas stream GS. This may be inert nitrogen gas. In a third method step III, the dried precursor layer PLD is gassed with a moist reactant gas RG, in this case moist anhydrous ammonia, again within the vessel V. The moist anhydrous ammonia is prepared by simple injection of nitrogen $N_2$ into a bubbler B containing a concentrated solution of ammonia ($NH_4OH$) and water ($H_2O$). Following gassing, a hydroxide layer HL has been formed on the substrate S. In the present embodiment, they layer consist of zinc hydroxide $Zn(OH)_2$. Drying and gassing may also be carried out in separate vessels V.

In a fourth method step IV the substrate S provided with the zinc hydroxide $Zn(OH)_2$ is inserted in a furnace H. By feeding in energy during method step IV, the $Zn(OH)_2$ is thermally converted by dehydration to zinc oxide (ZnO). The oxidic or ceramic layer OL/CL completely covers the substrate over its entire accessible surface, including any internal one, and assumes its functionality thereon. Any succeeding method step of rinsing and drying is optional and has, therefore, not been depicted. Depending upon the desired layer thickness, the method steps described can be cyclically repeated several times.

Figure 2:
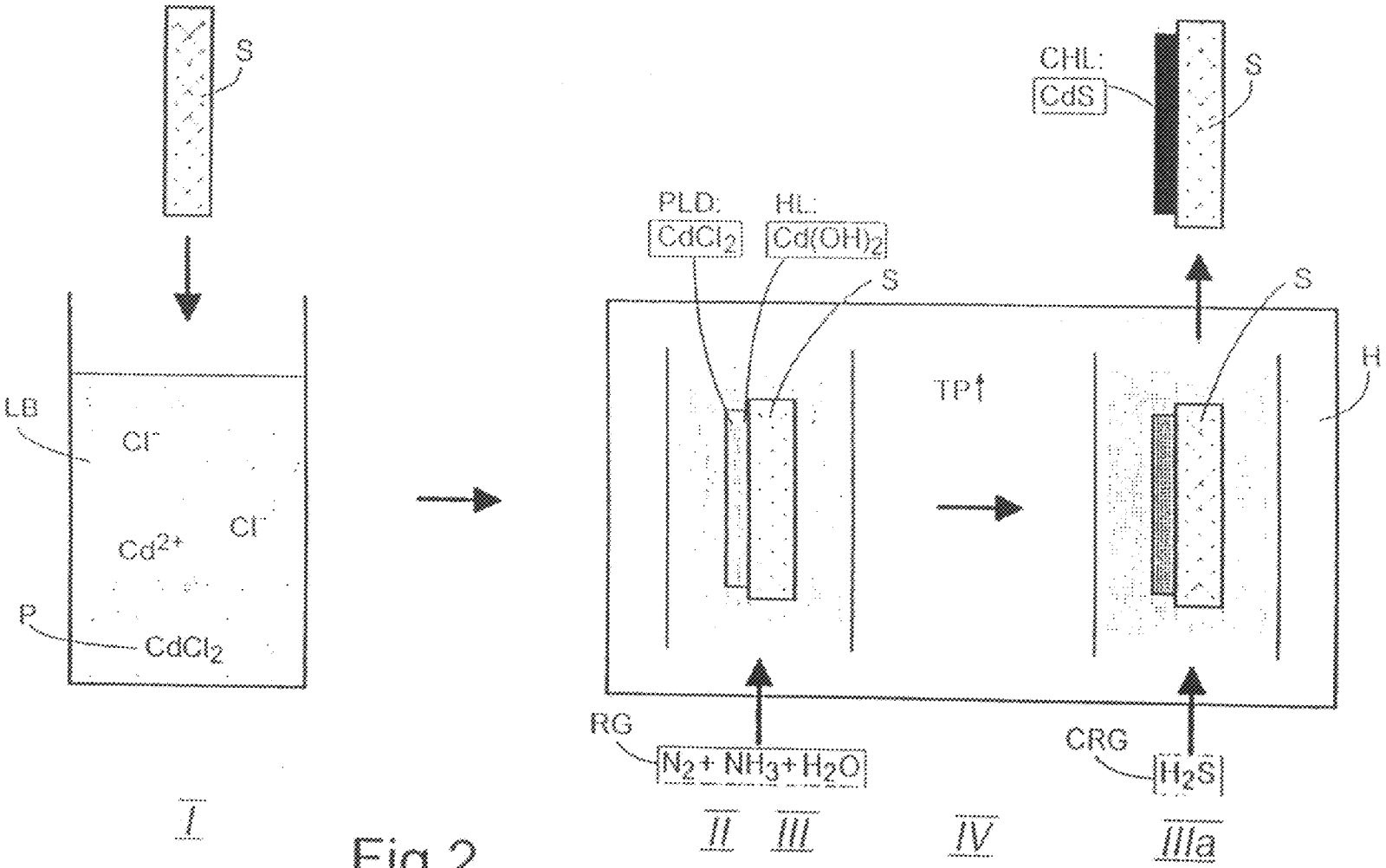

FIG. 2 schematically depicts the sequence of the inventive method of making other chalcogenidic coatings, cadmium sulfide (CDS being used as an example. For method steps and reference characters not elaborated on in this instance, reference may be had to the description of FIG. 1. The execution of method steps I to III with adsorption P ($CdCl_2$), drying PLD ($CdCl_2$), gassing ($N_2$+$NH_3$) and hydroxide formation HL ($Cd(OH)_2$) is followed by a further method step IIIa in which the formed hydroxide layer HL ($Cd(OH)_2$) is brought into contact with an additional reactant gas CRG containing chalcogen hydrogen compounds. This method step IIIa—the chalcogenizing step—results in the formation on the substrate S of a chalcogenidic coating CHL of cadmium sulfide (CDS). During execution of method steps I-IIIa, the process temperature TP is raised, for instance by carrying out the method steps in a glazing furnace H, to improve the material conversion. The thermal treatment in method step IV thus extends over both gassings III, IIIa.

LIST OF REFERENCE CHARACTERS

B bubbler
C lid
CHL chalcogenidic layer
CL ceramic layer
CRG reactant gas containing chalcogen hydrogen compounds;
H furnace HL hydroxide layer
LB solution bath
OL oxidic layer
P precursor
PL precursor layer
PLD dried precursor layer
RG moist reactant gas
S substrate
SH substrate holder
TP process temperature
V vessel

What is claimed is:

1. A method of producing a thin and poorly soluble coating layer on a substrate, the method comprising:

I. applying at least one precursor to a surface of the substrate so as to form a precursor layer thereon, II. drying the precursor layer by at least one of a stream of inert gas and evaporation, III. gassing the precursor layer with a moist reactant gas so as to convert the precursor layer into an intermediate layer including at least one of a hydroxide layer and a complex layer, the moist reactant gas being formed by bubbling nitrogen through a solution of aqueous ammonia, and IV. thermally treating the intermediate layer so as to produce the coating layer on the substrate, the coating layer being at least one of ceiamic and oxidic, and, wherein steps I-IV are repeated until the coating layer is of a desired thickness.

2. The method according to claim 1, wherein the thermal treatment step is performed by at least one of separately heating the intermediate layer following formation thereof and raising a process temperature during formation of the intermediate layer.

3. The method according to claim 1, wherein the applying of at least one precursor step is performed by applying the solution onto the substrate by at least one of immersion and spraying.

4. The method according to claim 1, wherein the at least one precursor includes a salt.

5. The method according to claim 1, wherein the at least one precursor includes a mixture of different compounds.

6. The method according to claim 1, wherein different precursors are used when the applying the at least one precursor step is repeated.

7. The method according to claim 1, further comprising, after the thermally treating the intermediate layer, rinsing the substrate and drying the substrate after the rinsing.

8. The method according to claim 1, wherein the at least one precursor includes at least one metal halogen.

9. The method according to claim 7, wherein the at least one metal halogen includes $ZnCl_2$.

10. A method of producing a thin and poorly soluble coating layer on a substrate, the method comprising:

I. applying at least one precursor including at least one metal halogen to a surface of the substrate so as to form a precursor layer thereon, II. drying the precursor layer by at least one of a stream of inert gas and evaporation, III. gassing the precursor layer with a moist reactant gas so as to convert the precursor layer into an intermediate layer including at least one of a hydroxide layer and a complex layer, and IV. thermally treating the intermediate layer so as to produce the coating layer on the substrate, the coating layer being at least one of ceramic and oxidic, and wherein steps I-IV are repeated until the coating layer is of a desired thickness.

11. The method according to claim 10, wherein the at least one metal halogen includes $ZnCl_2$.

12. The method according to claim 10, wherein the thermal treatment step is performed by at least one of separately heating the intermediate layer following formation thereof and raising a process temperature during formation of the intermediate layer.

13. The method according to claim 10, wherein the applying of at least one precursor step is performed by applying the solution onto the substrate by at least one of immersion and spraying.

14. The method according to claim 10, wherein the moist reactant gas includes at least one of an alkaline reactive gas and gaseous water.

15. The method according to claim 10, wherein the at least one precursor includes a mixture of different compounds.

16. The method according to claim 10, wherein different precursors are used when the applying the at least one precursor step is repeated.

* * * * *